US008654156B2

(12) United States Patent
Chou

(10) Patent No.: US 8,654,156 B2
(45) Date of Patent: Feb. 18, 2014

(54) DRIVER CIRCUIT OF DISPLAY AND METHOD FOR CALIBRATING BRIGHTNESS OF DISPLAY

(75) Inventor: Yen-Ynn Chou, Taipei County (TW)

(73) Assignee: Princeton Technology Corporation, Hsin Tien, Taipei County (TW)

( * ) Notice: Subject to any disclaimer, the term of this patent is extended or adjusted under 35 U.S.C. 154(b) by 983 days.

(21) Appl. No.: 12/650,405

(22) Filed: Dec. 30, 2009

(65) Prior Publication Data

US 2010/0165008 A1 Jul. 1, 2010

(30) Foreign Application Priority Data

Dec. 31, 2008 (TW) ..... 97151773 A

(51) Int. Cl.
*G09G 5/10* (2006.01)

(52) U.S. Cl.
USPC ..... 345/690; 345/691; 345/692

(58) Field of Classification Search
USPC ..... 345/76–98, 204–214, 690–692; 340/470–479, 908.1, 908; 257/401, 257/347, 355
See application file for complete search history.

(56) References Cited

U.S. PATENT DOCUMENTS 5,257,020 A * 10/1993 Morse ..... 340/908.1
5,305,210 A * 4/1994 Kuzma et al. ..... 702/4
5,319,553 A * 6/1994 Gregg et al. ..... 702/4
5,325,299 A * 6/1994 Moses et al. ..... 702/4
5,450,328 A * 9/1995 Janke et al. ..... 702/65
5,796,376 A * 8/1998 Banks ..... 345/82
6,320,325 B1 * 11/2001 Cok et al. ..... 315/169.3
6,897,842 B2 * 5/2005 Gu ..... 345/90
7,009,254 B2 * 3/2006 Nagasawa et al. ..... 257/355
2003/0052904 A1 * 3/2003 Gu ..... 345/691
2004/0212548 A1 * 10/2004 Ruttenberg ..... 345/1.1
2005/0212063 A1 * 9/2005 Nakano et al. ..... 257/401
2005/0230757 A1 * 10/2005 Nagasawa et al. ..... 257/355
2006/0007249 A1 * 1/2006 Reddy et al. ..... 345/690
2007/0182684 A1 * 8/2007 Sempel ..... 345/92
2007/0228469 A1 * 10/2007 Nakano et al. ..... 257/347
2007/0268216 A1 * 11/2007 Arai et al. ..... 345/68
2008/0088549 A1 * 4/2008 Nathan et al. ..... 345/80
2010/0277400 A1 * 11/2010 Jeong ..... 345/76

* cited by examiner

*Primary Examiner* — Prabodh M Dharia
(74) *Attorney, Agent, or Firm* — Muncy, Geissler, Olds & Lowe, PLLC

(57) ABSTRACT

A driver circuit for driving at least a pixel of a displayer, including an output stage, a calibration device and a surge suppression device. The output stage is coupled to the pixel and controlled by a pixel signal to switch an output voltage on the pixel between a high level and a low level. The calibration device is coupled between the output stage and the pixel and comprises an input end controlled by a bias voltage to calibrate an equivalent resistance of the calibration device for further calibrating a brightness level of the pixel. The surge suppression device is coupled between the input end of the calibration device and the pixel signal, and is used to suppress surges in the bias voltage which occur due to switching of the output voltage.

15 Claims, 5 Drawing Sheets

DRIVER CIRCUIT OF DISPLAY AND METHOD FOR CALIBRATING BRIGHTNESS OF DISPLAY

CROSS REFERENCE TO RELATED APPLICATIONS

This Non-provisional application claims priority under 35 U.S.C. §119(a) on Patent Application No(s). 097151773, filed in Taiwan, Republic of China on Dec. 31, 2008, the entire contents of which are hereby incorporated by reference.

BACKGROUND OF THE INVENTION

1. Field of the Invention

The present invention relates to displays, and in particular relates to driver circuits of displays.

2. Description of the Related Art

FIG. 1 is a schematic diagram illustrating a driver circuit in the prior art. The driver circuit 100 comprises a pixel 102 and an output stage 104 for driving the pixel 102. The output stage 104 of the driver circuit 100 further comprises a p-type MOSFET (PMOS) 112 and an n-type MOSFET (NMOS) 114, and each of the transistors 112 and 114 comprises a gate coupled to a pixel signal $S_p$ and controlled by the pixel signal $S_p$ to switch an output voltage $V_{out}$ on the pixel between a high level $V_H$ and a low level $V_{GND}$.

The output voltage $V_{out}$ on the pixel 102 and characteristic of a display influences the brightness of the pixel. Taking a carbon nanotube display (CNDP) for example, owing to its particular characteristics, the brightness of the carbon nanotube display will increase as the carbon nanotube display ages. For this reason, it is necessary for the driver circuit 100 to have a calibration device 130 to calibrate the brightness of the carbon nanotube display. For example, in the calibration device 130 in FIG. 1, the transmission gate composed of a PMOS $T_1$ and an NMOS $T_2$ is controlled by a bias voltage $V_{bias}$ to calibrate an equivalent resistance of the calibration device 130 to further calibrate brightness level of the pixel 102.

However, the coupling effect of the transistor $T_1$ (due to the coupling capacitor between the gate and the source/drain) makes the output voltage $V_{out}$ reversely influence the bias voltage $V_{bias}$, as shown in FIG. 2. The output voltage $V_{out}$ on the pixel 102 alternates between two voltage levels according to the pixel signal $S_P$. When the output voltage $V_{out}$ switches from the low voltage $V_{GND}$ to the high voltage $V_H$, the output voltage makes the bias voltage $V_{bias}$ rise sharply and causes a surge $P_1$ therein. When the output voltage $V_{out}$ switches from the high voltage $V_H$ to the low voltage $V_{GND}$, the output voltage makes the bias voltage $V_{bias}$ fall sharply and causes a surge $P_2$ therein. In addition, because the driver circuit 100 of the display is a high voltage device, a high voltage $V_H$ on the pixel 102, may be as high as 110 volts. Once the bias voltage $V_{bias}$ changes, the equivalent resistance of the calibration device 130 accordingly changes, thus causing luminance flicker on the display.

BRIEF SUMMARY OF INVENTION

Provided is a driver circuit for driving at least a pixel of a displayer. The driver circuit comprises: an output stage coupled to the pixel and controlled by a pixel signal to switch an output voltage on the pixel between a high level and a low level; a calibration device coupled between the output stage and the pixel and comprising an input end controlled by a bias voltage to calibrate an equivalent resistance of the calibration device for further calibrating a brightness level of the pixel; and a surge suppression device coupled between the input end of the calibration device and the pixel signal for suppressing surges in the bias voltage which occur due to switching of the output voltage.

Provided is a method for calibrating brightness of a display. The method comprises: disposing a driver circuit, wherein the driver circuit comprises at least an output stage, and the output stage is coupled to a pixel of a display and is controlled by a pixel signal to switch an output voltage on the pixel between a high level and a low level; disposing a calibration device between the output stage and the pixel; imposing a bias voltage on the calibration device to calibrate an equivalent resistance of the calibration device for further calibrating a brightness level of the pixel; and suppressing surges in the bias voltage which occur due to switching of the output voltage.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 3:
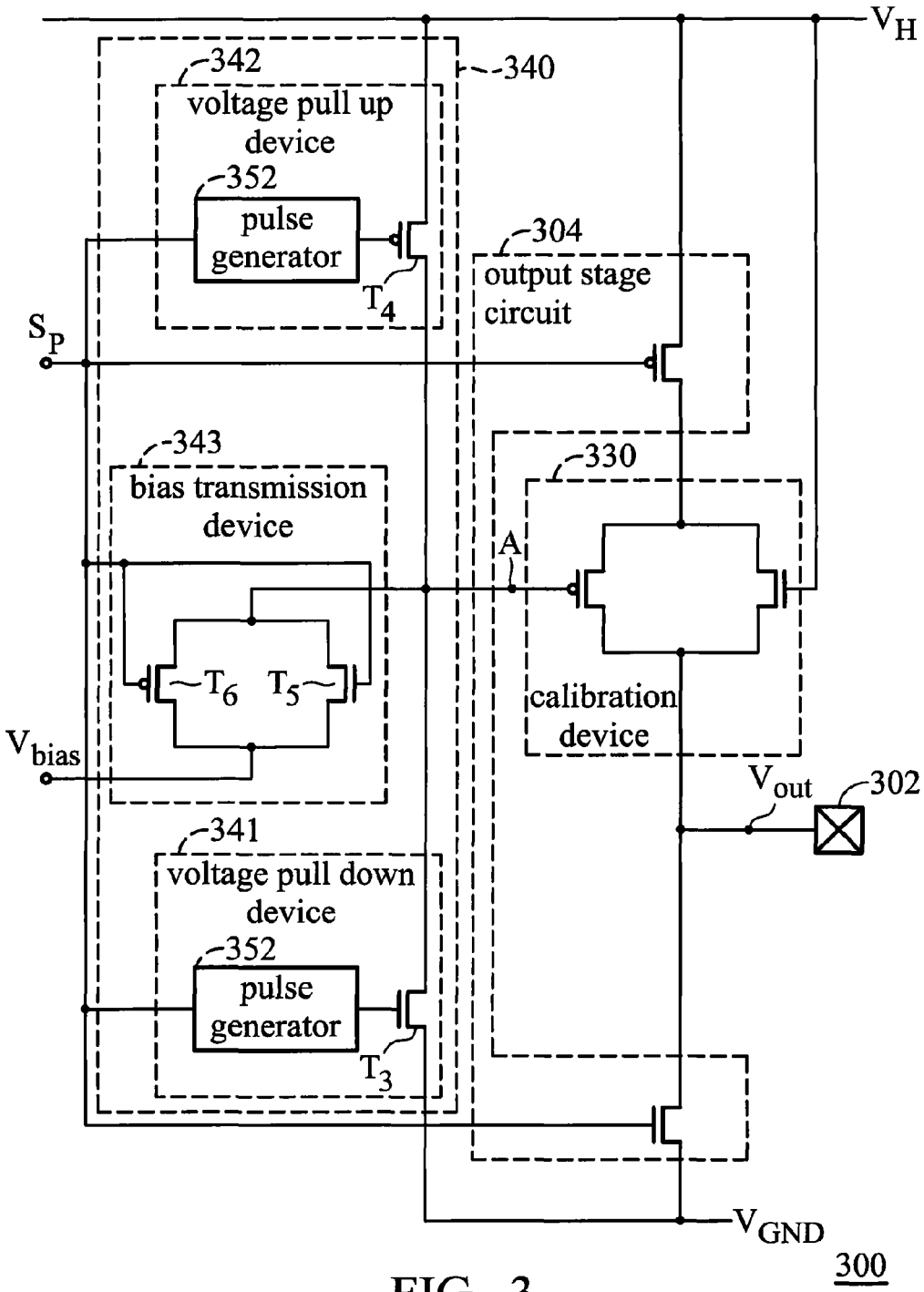
FIG. 3 is a schematic diagram of the driver circuit according to the present invention.

FIG. 3 is a schematic diagram of the driver circuit according to the present invention. The driver circuit 300 comprises a pixel 302, an output stage circuit 304 and a calibration device 330. The output stage circuit 304 is coupled to the pixel 302 and controlled by a pixel signal $S_p$ to switch the output voltage $V_{out}$ of the pixel 302 between a high level $V_H$ and a low level $V_{GND}$. The calibration device 330 is coupled between the output stage circuit 304 and the pixel 302 and comprises an input end A for being controlled by a bias voltage $V_{bias}$ to calibrate an equivalent resistance of the calibration device 330 for pixel brightness calibration. In order to solve the problems mentioned in the prior art, the driver circuit 300 in the present invention further comprises a surge suppression device 340. The surge suppression device 340 is coupled between the input end A of the calibration device 330 and the pixel signal $S_P$ for suppressing surges in the bias voltage $V_{bias}$ result from switching of the output voltage $V_{out}$.

Figure 1:
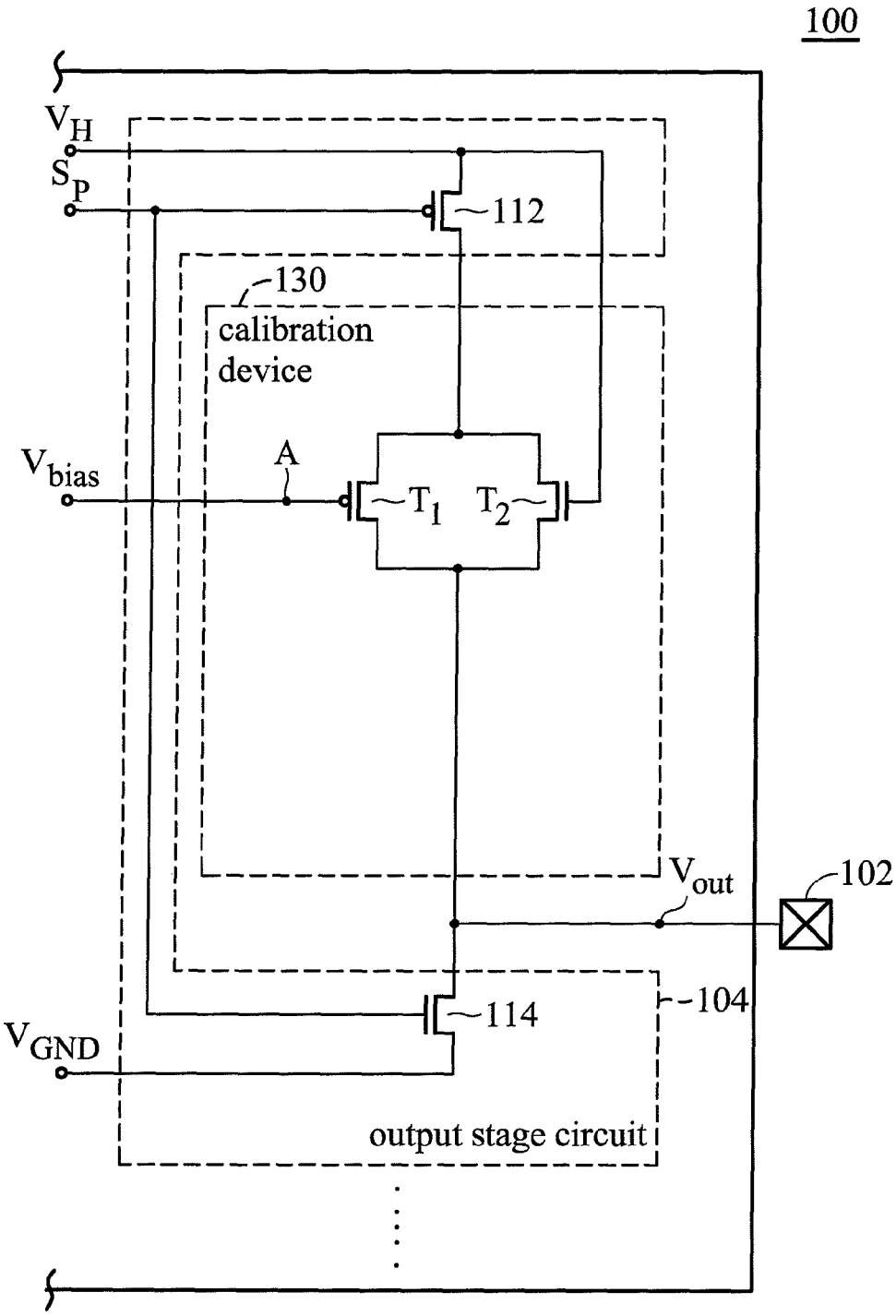
FIG. 1 ( PRIOR ART )
FIG. 1 is a schematic diagram illustrating a driver circuit according to the prior art.
Figure 2:
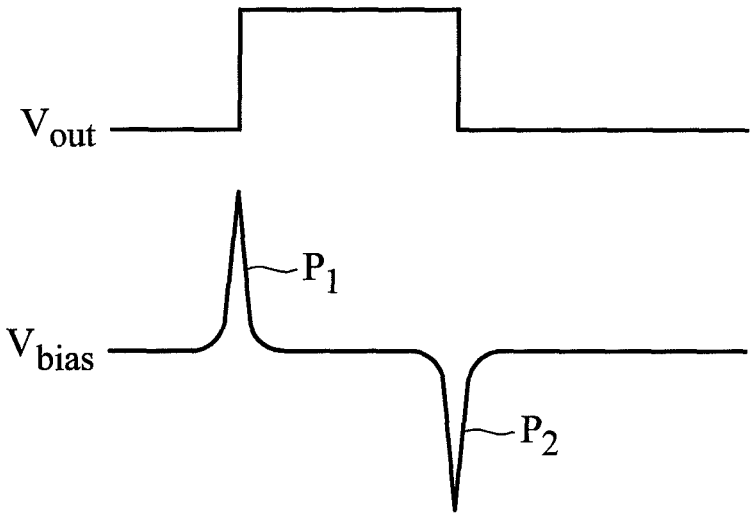
FIG. 2 ( PRIOR ART )
FIG. 2 shows timing diagrams of an output voltage and a bias voltage.

In an embodiment, the surge suppression device 340 of the driver circuit 300 comprises a voltage pulling down device 341 for pulling down the bias voltage when the output voltage $V_{out}$ switches from the high level $V_H$ to the low level $V_{GND}$. In this embodiment, the pulling down operation is performed by the n-MOSFET $T_3$ which has a gate coupled to the pixel signal $S_P$, a drain coupled to the input end A of the calibration device 330, and a source coupled to a low voltage point. For convenience, the low voltage point here is the same as the grounded voltage $V_{GND}$, but the present invention is not limited thereto. When the pixel signal $S_P$ is high and turns the transistor $T_3$ on, the voltage level on the drain (which is high) will be pulled down immediately to the grounded voltage $V_{GND}$ in order to generate a voltage to neutralize the surge $P_1$ as shown in FIG. 2. In addition, those skilled in the art know that the pixel signal $S_P$ must be transformed to a pulse before being to the transistor $T_3$. Thus, it is necessary for the voltage pulling down device 341 to comprise a pulse generator 351. The pulse generator 351 is composed of a plurality of logic gates connected in series, which is well-known in the prior art and not discussed further for brevity.

The surge suppression device 340 of the driver circuit 30 of the present invention further comprises a voltage pulling up device 342 for pulling up the bias voltage $V_{bias}$ when the output voltage $V_{out}$ switches from the high level $V_H$ to the low level $V_{GND}$. In this embodiment, the pulling up operation is performed by the p-MOSFET $T_4$ which has a gate coupled to the pixel signal $S_P$, a drain coupled to the input end A of the calibration device 330, and a source coupled to a high voltage point. For convenience, the high voltage point is the same as the high voltage $V_H$, and the present invention is not limited thereto. When the pixel signal $S_P$ is low and turns the transistor $T_4$ on, the voltage level on the drain (which is low) will be pulled up immediately to the high voltage $V_H$ in order to generate a voltage to neutralize the surge $P_2$ as shown in FIG. 2. In addition, those skilled in the art know that the pixel signal $S_P$ must be transformed to a pulse before being transmitted to the transistor $T_4$. Thus, it is necessary for the voltage pulling up device 342 to comprise a pulse generator 352. The pulse generator 352 is composed of a plurality of logic gates connected in series, which is well-known in the prior art and not discussed further for brevity.

The surge suppression device 340 of the driver circuit 300 of the present invention further comprises a bias transmission device 343, which is coupled between a bias source (not shown) and the input end A of the calibration device 330 and used for transmitting the bias voltage $V_{bias}$ provided by the bias source to the input end A of the calibration device 330. Even if a stable bias voltage $V_{bias}$ is provided by the bias source, the voltage on the input end A of the calibration device 330 would be unstable, so that the bias transmission device 343 must stabilize the voltage of the calibration device 330 at the normal level. There are numerous methods to implement the bias transmission gate 343. For example, the bias transmission gate 343 could be composed of a n-MOSFET $T_5$ and a p-MOSFET $T_6$, wherein the gates of the transistor $T_5$ and $T_6$ are both coupled to the pixel signal $S_p$, the source of the transistor $T_5$ and the drain of the transistor $T_6$ are both coupled to the bias source, and the drain of the transistor $T_5$ and the source of the transistor $T_6$ are both coupled to the input end A of the calibration device 330.

Figure 4A:
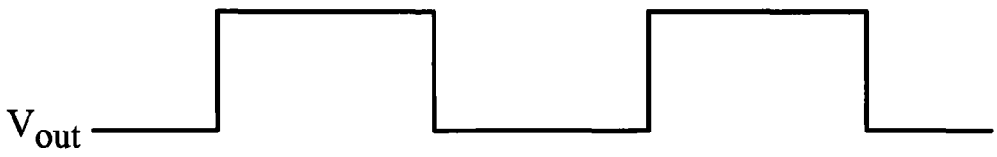
FIG. 4A shows the timing diagram of the output voltage.
Figure 4B:
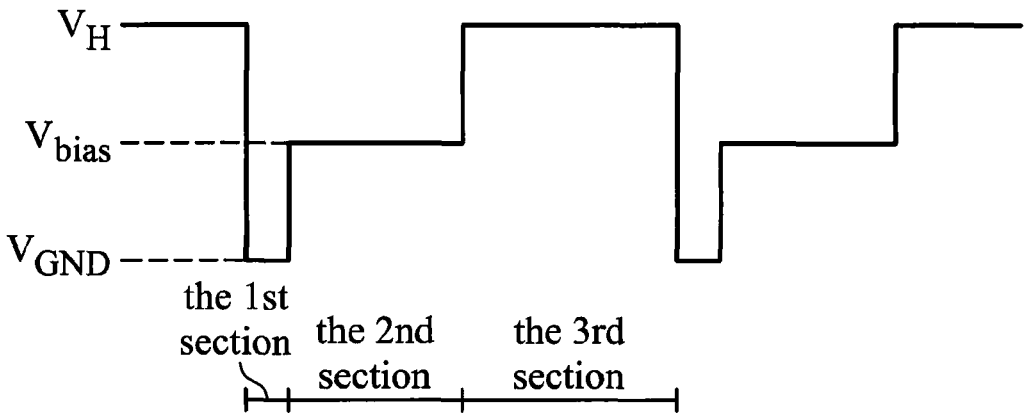
FIG. 4B shows the timing diagram of the voltage provided by the surge suppression device.

In an embodiment, the surge suppression device 340 comprises the voltage pulling down device 341, the voltage pulling up device 342 and the bias transmission device 343. FIG. 4A shows the timing diagram of the output voltage $V_{out}$, and FIG. 4B shows the timing diagram of the voltage provided by the surge suppression device 340. In FIG. 4B, the section 1, section 2 and section 3 are respectively caused by the voltage pulling down device 341, the bias transmission device 343 and the voltage pulling up device 342. In the section 1, the voltage is pulled down to the grounded voltage $V_{GND}$ to neutralize the surge $P_1$ as shown in FIG. 2, in section 2, the voltage is stabilized to be at the ideal level, and the level of the bias voltage $V_{bias}$, and in section 3, the voltage is pulled up to the high voltage $V_H$ to neutralize the surge $P_2$ as shown in FIG. 2. Due to the surge suppression device 340 of the present invention, the voltage received by the calibration device 330 is stabilized at the level of the bias voltage $V_{bias}$, and brightness problems of the prior art are mitigated.

Figure 5:
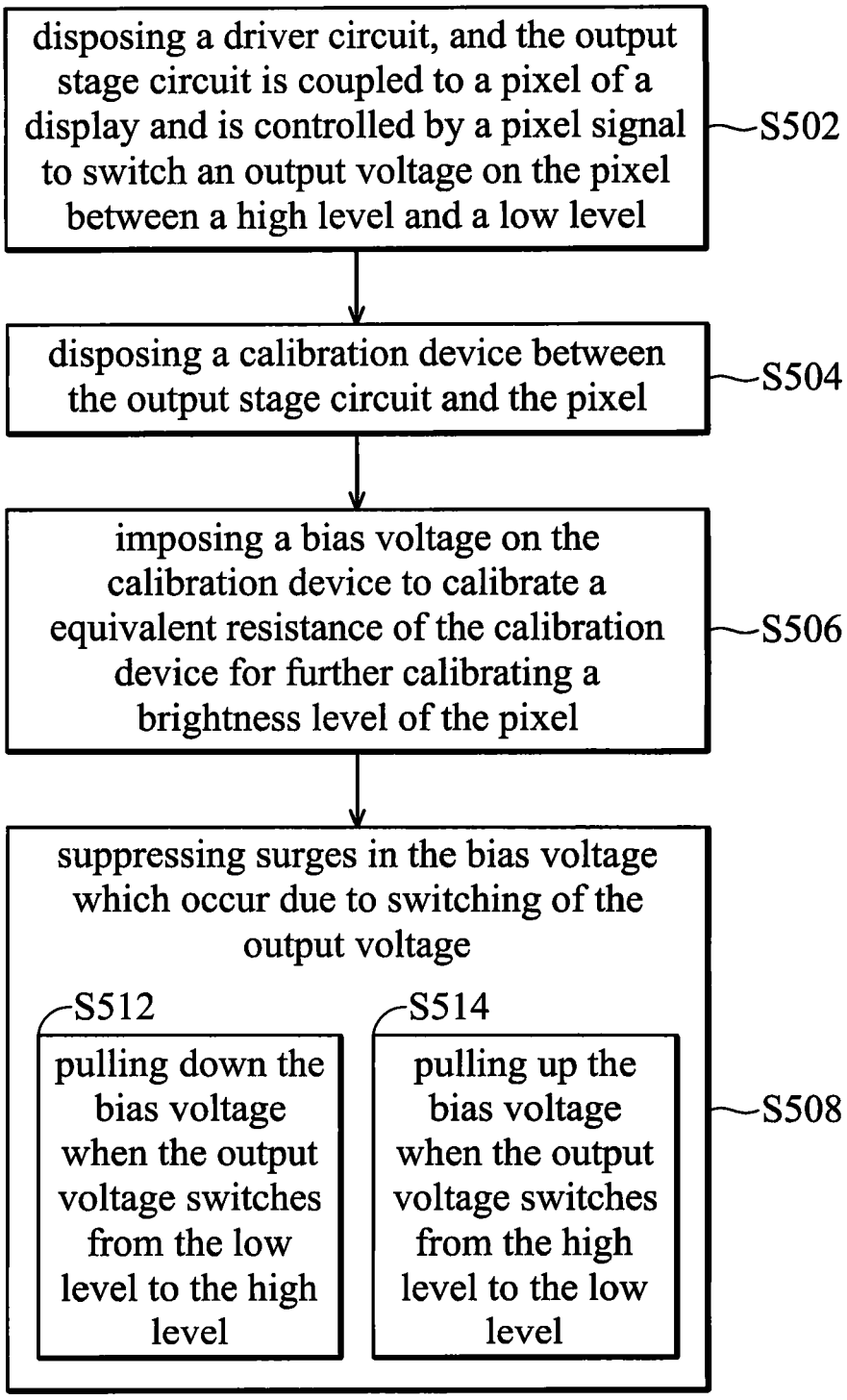
FIG. 5 is a flow chart of a method for calibrating brightness of a display according to the present invention.

FIG. 5 is a flow chart of a method for calibrating brightness of a display according to the present invention. Refer to FIG. 5 and FIG. 3, the method comprises in step S502, disposing a driver circuit 300, wherein the driver circuit 300 comprises at least an output stage circuit 304, wherein the output stage circuit 304 is coupled to a pixel 302, and the output stage circuit 304 is controlled by a pixel signal $S_P$ to switch an output voltage $V_{out}$ on the pixel 302 between a high level $V_H$ and a low level $V_{GND}$. In step S504, disposing a calibration device 330 between the output stage circuit 304 and the pixel 302. In step S506, imposing a bias voltage $V_{bias}$ on the calibration device 330 to calibrate a equivalent resistance of the calibration device 330 for further calibrating a brightness level of the pixel 302I, and in step S508, suppressing surges in the bias voltage $V_{bias}$ which occur due to switching of the output voltage $V_{out}$. The step S508 further comprises in step S512, pulling down the bias voltage $V_{bias}$ when the output voltage $V_{out}$ switches from the low level $V_{GND}$ to the high level $V_H$, and in step S514, pulling up the bias voltage $V_{bias}$ when the output voltage $V_{out}$ switches from the high level $V_H$ to the low level $V_{GND}$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driver circuit for driving at least a pixel of a displayer, comprising:

an output stage circuit coupled to the pixel and controlled by a pixel signal to switch an output voltage of the pixel between a high level and a low level;

a calibration device coupled between the output stage circuit and the pixel, wherein the calibration device includes an input end controlled by a bias voltage for calibrating an equivalent resistance of the calibration device to calibrate a brightness level of the pixel;

a surge suppression device coupled between the input end of the calibration device and the pixel signal; and first and second pulse generators for suppressing surges in the bias voltage resulted from switching of the output voltage.

2. The driver circuit as claimed in claim 1, wherein the surge suppression device comprises a voltage pull down device for pulling down the bias voltage when the output voltage switches from the high level to the low level.

3. The driver circuit as claimed in claim 2, wherein the voltage pull down device includes a first transistor having a first gate coupled to the pixel signal; a first drain coupled to the input end of the calibration device; and a first source coupled to a low level point.

4. The driver circuit as claimed in claim 2, wherein the voltage pull down further comprises a first pulse generator coupled between the pixel signal and the first gate for generating a first pulse.

5. The driver circuit as claimed in claim 1, wherein the surge suppression device further comprises a voltage pull up device for pulling up the bias voltage when the output voltage switches from the high level to the low level.

6. The driver circuit as claimed in claim 5, wherein the voltage pull up device includes a second transistor, wherein the second transistor includes a second gate coupled to the pixel signal; a second drain coupled to the input end of the calibration device; and a second source coupled to a high level point.

7. The driver circuit as claimed in claim 6, wherein the voltage pull up device further comprises a second pulse generator coupled between the pixel signal and the second gate for generating a second pulse.

8. The driver circuit as claimed in claim 1, wherein the surge suppression device comprises a bias transmission device coupled between a bias source and the input end of the calibration device for transmitting the bias voltage provided by the bias source to the input end of the calibration device.

9. The driver circuit as claimed in claim 8, wherein the bias transmission device comprises:

a third transistor comprising, wherein the third transistor includes (a) a third gate coupled to the pixel signal, (b) a third source coupled to the bias source and (c) a third drain coupled to the input end of the calibration device; and a fourth transistor, wherein the fourth transistor includes (i) a fourth gate coupled to the pixel signal, (ii) a fourth source coupled to the input end of the calibration device and (iii) a fourth drain coupled to the bias source.

10. The driver circuit as claimed in claim 3, wherein the second transistor includes an n-type MOSFET.

11. The driver circuit as claimed in claim 6, wherein the second transistor includes a p-type MOSFET.

12. The driver circuit as claimed in claim 9, wherein the third transistor includes an n-type MOSFET, and the fourth transistor includes a p-type MOSFET.

13. A method for calibrating brightness of a display, comprising:

disposing a driver circuit, wherein the driver circuit includes at least an output stage circuit coupled to a pixel of the display and controlled by a pixel signal to switch an output voltage of the pixel between a high level and a low level;

disposing a calibration device between the output stage circuit and the pixel;

imposing a bias voltage on the calibration device for calibrate a equivalent resistance of the calibration device to calibrate a brightness level of the pixel; and suppressing surges, using a pulse generator, in the bias voltage resulted from switching of the output voltage.

14. The method as claimed in claim 13 further comprising pulling down the bias voltage when the output voltage switches from the low level to the high level.

15. The method as claimed in claim 13 further comprising pulling up the bias voltage when the output voltage switches from the high level to the low level.

* * * * *